US005155047A

United States Patent [19]

Cioni et al.

[11] Patent Number: 5,155,047

[45] Date of Patent: Oct. 13, 1992

[54] METHOD AND APPARATUS FOR MEASURING AND CONTROLLING EFFICIENCY OF A COMBUSTION

[75] Inventors: Mario Cioni; Gennaro De Michele, both of Pisa; Mirella Musci, Cernusco Sul Naviglio; Franco Curcio, Pioltello, all of Italy

[73] Assignee: ENEL - Ente Nazionale per l'Energia Elettrica, Rome, Italy

[21] Appl. No.: 85,186

[22] Filed: Sep. 20, 1990

[30] Foreign Application Priority Data

Oct. 3, 1989 [IT] Italy ..... 21912 A/89

[51] Int. Cl.[5] ..... G01N 21/85; G01N 21/75; G01N 33/22

[52] U.S. Cl. ..... 436/139; 436/55; 436/155; 436/160; 436/171; 422/82.05; 422/78; 110/347; 356/318

[58] Field of Search ..... 436/160, 171, 165, 145, 436/137, 155, 55, 139; 356/312, 319, 318; 422/78, 98, 82.05; 219/121.6, 121.61, 121.85, 121.86; 110/347, 341; 374/36, 37, 38

[56] References Cited

U.S. PATENT DOCUMENTS

| | | | |
|---|---|---|---|
| 4,382,698 | 5/1983 | Szonntagh | 374/37 |
| 4,416,226 | 11/1983 | Nishida et al. | 123/143 B |
| 4,533,258 | 8/1985 | Milovidov | 374/38 |
| 4,562,044 | 12/1985 | Bohl | 436/160 |
| 4,729,657 | 3/1988 | Cooper et al. | 356/319 |
| 4,879,449 | 11/1989 | Duley et al. | 219/121.6 |
| 4,894,511 | 1/1990 | Caledonia et al. | 219/121.6 |
| 4,976,930 | 12/1990 | Kishida et al. | 219/121.6 |
| 5,003,891 | 4/1991 | Kaneko et al. | 110/341 |

FOREIGN PATENT DOCUMENTS

| | | | |
|---|---|---|---|
| 1485323 | 6/1967 | France . | |
| 2539230 | 7/1984 | France . | |
| 140119 | 11/1980 | Japan | 356/319 |
| 2090524 | 4/1987 | Japan | 356/319 |
| 0828031 | 6/1981 | U.S.S.R. | 356/319 |
| 2036290 | 6/1980 | United Kingdom . | |

OTHER PUBLICATIONS

Japanese Abstracts: vol. 12, No. 248, Jul. 13, 1988.
Japanese Abstracts vol. 16, No. 63 35716.

*Primary Examiner*—James C. Housel
*Assistant Examiner*—David Reddig
*Attorney, Agent, or Firm*—Keil & Weinkauf

[57] ABSTRACT

A method and an apparatus for measuring and controlling the efficiency of a combustion whereby, ash samples are drawn at predetermined time intervals from a region of a combustion plant, each drawn sample is set in an exhausted reaction cell, combustion reaction gas is introduced under controlled pressure, a superficial layer of the sample is heated to the carbon combustion temperature by a $CO_2$ laser beam, the reaction gas is drawn from the cell and the amount of carbon dioxide produced by the carbon combustion is measured in a calibrated detector. The amount of unburnt carbon contained in the ashes is determined based on a preceding calibration carried out on ashes of known carbon content.

11 Claims, 1 Drawing Sheet

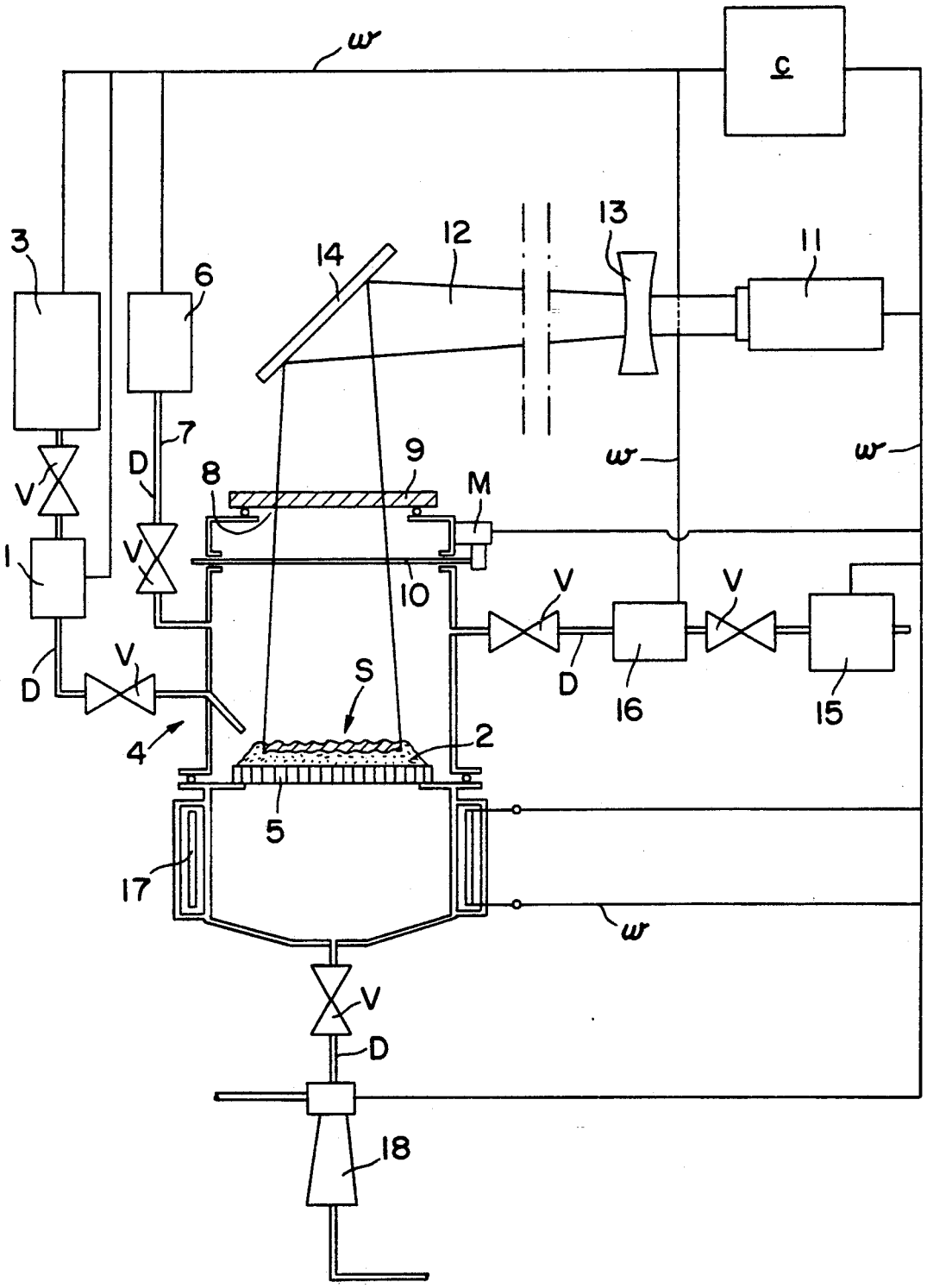
w
C
3
6
14
12
13
11
7
D
V
8
9
M
w
w
1
V
10
V
V
D
V
S
D
16
15
4
2
5
17
w
V
D
18

METHOD AND APPARATUS FOR MEASURING AND CONTROLLING EFFICIENCY OF A COMBUSTION

The present invention refers to a method for measuring the efficiency of a combustion, in particular a method for measuring in real time the content of unburnt carbon in the coal ashes and an apparatus for carrying out the method.

There are known chemical methods used in a laboratory for measuring the unburnt carbon amount in ashes. Such methods involve intricate operational sequences and long time periods which make them unsuitable for controlling a combustion in real time.

However, a method for the combustion control in real time allows one to optimize the combustion and to get the consequent advantages of energy saving, high quality ash production and less environmental pollution. Obviously, such a method has the additional advantage of allowing control of the combustion in a transient state or, anyway, in non standard operation conditions.

By the techniques practiced previously for measuring unburnt material amounts in real time, ash samples are drawn through suitable flues in communication with a boiler and a property related to the unburnt carbon content is detected in the shortest possible time.

Examples of such known techniques are those that: are based on the optical analysis of samples wherein the heat depends on the elementary carbon content; measure the sample weight variation before and after heating in air since carbon develops by combustion; measure the reflection factor of a microwave signal since the dielectric constant of the ashes depends on their chemical composition.

All the above techniques have great inaccuracy since the measured properties are related to the unburnt carbon content in an indirect and often non univocal way. Moreover, these techniques require that the amount of the ashes tested be known exactly and often require that considerable amount of material be drawn (tens of grams) which means extending the time necessary for measurement.

According to the invented method, as characterized in the appended claims, the measurement is carried out on the developed carbon dioxide and/or on the decrease of the oxygen in a reaction cell during a superficial and localized combustion caused by a laser beam in a small analysis ash sample. The coal ashes substantially consist of aluminium silicates presenting a strong absorption band in the mean infrared region wherein the $CO_2$ laser maximum gain line falls, which makes such laser suitable to this purpose, i.e., the laser beam is so well absorbed by said aluminium silicates that its radiation is absorbed in a superficial layer of a few tenths millimeter thickness in said analysis sample and is converted into heat. It will be appreciated that the thickness of said layer depends on the ratio, w/s, between the laser beam power and the surface as hit by the same beam. Conveniently, said analysis sample will be some millimeters thick to prevent the heat produced by the laser from dispersing through the support whereon said sample is placed. The object of the laser beam is to heat a very small layer of ashes in the sample surface S rapidly (typically from 10 to 30 seconds) and locally up to high temperatures (700° C.–1200° C.), depending on laser power. In an oxidative environment caused by introduction of air or oxygen as reaction gas the unburnt carbon reacts with oxygen and produces carbon dioxide. The reaction gas is drawn from the inside of the reaction cell and the $CO_2$ amount is measured by means of a detector suitable to such gas. An adequate preliminary calibration, carried out in the invented apparatus on calibration ash samples having known carbon content, enables the establishment of a relation between the $CO_2$ amount, as produced in said cell, and the percentage content of unburnt carbon as contained in the analysis ash samples. In connection with predetermined laser beam specifications, the amount of the produced $CO_2$ is conditioned by the oxidative environment, i.e., the type of oxidation gas used and the pressure thereof. Obviously, the oxygen available in the cell shall be enough for completely burning the carbon contained in the reaction ash volume. As an alternative in addition to the $CO_2$ analysis, the oxygen consumption during combustion in said cell is measured in order to measure the carbon amount burnt and contained as unburnt carbon in an analysis sample. Moreover, attention is drawn to the fact that the necessary analysis sample contains only a few grams of ashes, for example two or three grams.

According to known methods, said detector may be associated with a programmer adapted at least: a) to drive the above described step sequence sequentially, i.e. at prescribed time intervals; b) to adjust the combustion plant operation according to a predetermined memorized program using the results of the analysis in said detector.

At least the following main advantages are afforded by this invention: directly detecting unburnt carbon amount through its transformation into $CO_2$; no longer requiring an exact measurement of the amount of the ashes as drawn since the laser radiation is absorbed in a layer of a few tenths of a millimeter thickness; rapidly measuring the amount of the unburnt carbon due to the kind of the heat source and to the small amount of material drawn and analyzed; supplying a method and an apparatus for measuring the combustion efficiency in real time.

Brief Description of the Drawing

The figure illustrates the elements of the invention including the analyzer and controller.

The invention will be described below in detail with reference to the accompanying drawing which illustrates only one specific embodiment.

The apparatus comprises: a device 1 for sequentially drawing an analysis ash sample 2 from a region in a combustion plant 3 located between the ash precipitator and the air-preheater, both not shown in the drawing; a reaction cell 4 bearing a filter-support 5 to support said analysis sample 2; an oxygen source 6 in communication with the inside of said reaction cell 4 through a duct 7 to supply said cell with a controlled amount of oxygen under controlled pressure; a port 8 opposite said filter-support 5 and closed with a plate 9 made of zinc selenide allowing the $CO_2$ laser beam to pass through; a baffle plate 10, located between said filter-support 5 and port 8, moved by motor means M between a closing position and the opening position shown in the drawing to protect said plate 9 from ash dust when analysis samples are introduced into the reaction cell; a $CO_2$ laser source 11 which directs the laser beam 12, through a lens 13 and a mirror 14, on a surface S of the analysis sample 2 set on the filter-support 5 in order to burn the carbon contained in a small layer of said surface S; an exhauster 15 which draws the gas from said reaction cell and delivers it in a calibrated detector 16 able to measure the amount of $CO_2$ in the reaction gas (the detector is of the NDIR type, non-dispersive infrared photometer); a further object of said exhauster 15 is to exhaust the reaction cell up to about 0.1 torr; an electric resistance heater 17 to remove possible humidity contained in the analysis sample 2; an ejector 18 to remove from the filter-support 5 and consequently from the reaction cell 4 the ash of the analysis sample at the end of the operation. All ducts D in the apparatus are controlled by solenoid valves V.

The operative means of the combustion plant 3 (fuel and air feeding, air and gas locks, registers, etc.), calibrated detector 16, motor means for the device 1, oxygen source 6, exhauster 15, ejector 18, baffle plate 10, laser source 11, solenoid valves V and electric resistance 17 are all associated in a conventional manner with a microprocessor controller C adapted to drive at predetermined time intervals the described analysis cycle and to adjust the working of the operative means of the combustion plant 3 depending on the analysis result as supplied from the detector 16 according to a predetermined optimized combustion program. Wires w connect said controller C with all controlled parts.

The laser power ranges from 20 to 30 watts; the diameter of laser beam on said surface S ranges from 8 to 15 mm; the analysis sample 2 has 4 mm thickness and 28 mm diameter; the reaction cell volume is 300 $cm^3$. The heat absorption due to laser radiation (=10,6 m) causes in the concerned material a temperature rise ranging from 900° C. and 1100° C. in a time period ranging from 10 to 15 seconds. The reaction gas in the reaction cell may be air or oxygen under a pressure ranging from 200 to 600 torr. Under said operative conditions and apparatus specifications, the amount of oxygen in said cell is enough to completely oxidize the ash volume as heated by the laser ($2,5\times10^{-2}$–$9,0\times10^{-2}$ $cm^3$) with a radiation time period ranging from 30 seconds to 2 minutes. The range of the unburnt carbon percentages which may be analyzed by means of this apparatus is from 1% to 40%.

After laser radiation, the carbon development from said sample is evidenced by a clear spot on said surface S.

We claim:

1. A method for measuring the efficiency of a coal combustion by analysis of an ash sample drawn from a region of a coal combustion plant in order to analyze a property of the ashes related to the unburnt carbon content in said ashes, which comprises:

a) drawing the ash sample to be analyzed from a region of a coal combustion plant and conveying said sample to a filter-support in a reaction cell hermetically sealed under controlled pressure;

b) exhausting said reaction cell;

c) supplying combustion reaction gas under controlled pressure into said reaction cell;

d) projecting on a surface of said sample a laser beam of sufficient kind and power to be absorbed by said sample and to heat a superficial layer of said sample to the carbon combustion temperature or higher;

e) withdrawing the gas present in said reaction cell, which includes $CO_2$ produced from combustion of said superficial layer of said sample and $O_2$ present in the combustion reaction gas but not taken up by the combustion, into a first or second calibrated detector;

f) either, measuring in said first calibrated detector the amount of $CO_2$ in the gas withdrawn from said reaction cell or, optionally, measuring in said second calibrated detector the amount of $O_2$ in the gas;

g) estimating the amount of unburnt carbon in said sample by comparison of the amount of $CO_2$ or $O_2$ in said withdrawn gas with the amount of $CO_2$ or $O_2$ measured from carrying out the above steps a)–e) on a sample of a known amount of unburnt carbon, the amount of unburnt carbon being an indicator of the efficiency of the combustion.

2. The method of claim 1 wherein said laser beam is a beam of a $CO_2$ laser.

3. The method of claim 1 wherein the time for said sample to reach the carbon combustion temperature is dependent on the laser beam power.

4. The method of claim 1 wherein the time for said sample to reach the carbon combustion temperature is dependent on the laser beam cross section.

5. The method of claim 1 wherein the time for said sample to reach the carbon combustion temperature is dependent on the laser beam power and cross section.

6. The method of claim 2 wherein the power of said laser beam is from 20 to 30 watts.

7. An apparatus for measuring the efficiency of combustion in a coal combustion plant, said apparatus comprising:

a device in flow communication with a reaction cell and constructed so as to be capable of connecting to the combustion plant for drawing ash samples from a region of the plant and transporting the samples to said reaction cell;

said reaction cell constructed so as to be sealed in order to form a controlled pressure space inside thereof and comprising a filter-support for supporting the ash samples supplied from said device, an aperture positioned on said reaction cell for passing a laser beam onto said filter-support, a baffle plate constructed so as to be movable between a closed an open position located between said aperture and said filter-support, wherein said aperture is sealed by a plate of material constructed so as to allow the laser beam to pass therethrough and said baffle plate is in a closed position when the ash samples are transported to said reaction cell;

means for heating said reaction cell in order to remove humidity contained in the ash samples;

a combustion reaction gas source in flow communication with the inside of said reaction cell and constructed so as to supply a controlled amount of reaction gas under controlled pressure;

a laser source constructed so as to generate the laser beam;

means for directing the laser beam on a surface of the ash sample positioned on said filter-support in order to combust any carbon contained in a superficial layer of the sample with the reaction gas thereby generating an amount of carbon dioxide or oxygen gas or a mixture thereof;

means in flow communication with a detector and said reaction cell for exhausting said reaction cell of said carbon dioxide and oxygen gas and transporting the gas to said detector;

said detector in flow communication with said reaction cell and calibrated so as to measure the amounts of one or more of the carbon dioxide and oxygen gas generated from said combustion;

an ejector constructed so as to remove the ash samples from said reaction cell after combustion.

8. The apparatus of claim 7 wherein said detector comprises a first detector calibrated for measuring the amount of carbon dioxide gas and a second detector calibrated for measuring the amount of oxygen gas.

9. The apparatus of claim 7 wherein the laser source is a $CO_2$ laser source.

10. The apparatus of claim 9 wherein said laser source is constructed so as to have a power ranging from 20 and 30 watts.

11. The apparatus of claim 7 in combination with a coal combustion plant, said apparatus further comprising a programmed controller means connected with the combustion plant, said detector, said sampling device, said reaction gas source, said baffle plate, said laser source, said means for positioning the source, said exhaust means, said ejector and said heating means for initiating at predetermined time intervals the sampling and analysis of the ash from the combustion plant, and for controlling the coal combustion of the combustion plant according to a predetermined program and the analysis results provided from said detector.

* * * * *

UNITED STATES PATENT AND TRADEMARK OFFICE

CERTIFICATE OF CORRECTION

PATENT NO. : 5,155,047

DATED : October 13, 1992

INVENTOR(S) : CIONI et al.

It is certified that error appears in the above-identified patent and that said Letters Patent is hereby corrected as shown below:

On the title page: Application No. should read: -- 585,186 --

In the Abstract: 5th line from the bottom, "the carbon combustion" should read -- the combustion --

Signed and Sealed this

Twenty-sixth Day of October, 1993

*Attest:*

Bruce Lehman

BRUCE LEHMAN

*Attesting Officer*

*Commissioner of Patents and Trademarks*